US012704350B2

(12) United States Patent
Van Den Heuvel, Jr.

(10) Patent No.: US 12,704,350 B2
(45) Date of Patent: Aug. 11, 2026

(54) SELF-DEFENSE DEVICE

(71) Applicant: Christian Van Den Heuvel, Jr., Santa Barbara, CA (US)

(72) Inventor: Christian Van Den Heuvel, Jr., Santa Barbara, CA (US)

(73) Assignee: Directed Alloy Solutions, LLC, Loveland, CO (US)

( * ) Notice: Subject to any disclaimer, the term of this patent is extended or adjusted under 35 U.S.C. 154(b) by 202 days.

(21) Appl. No.: 18/638,448

(22) Filed: Apr. 17, 2024

(65) Prior Publication Data

US 2025/0020431 A1 Jan. 16, 2025

Related U.S. Application Data

(60) Provisional application No. 63/460,071, filed on Apr. 18, 2023.

(51) Int. Cl.
*F41B 15/00* (2006.01)
*A45F 5/02* (2006.01)

(52) U.S. Cl.
CPC ..... *F41B 15/00* (2013.01); *A45F 5/021* (2013.01)

(58) Field of Classification Search
CPC ..... F41B 15/00; A45F 5/021
See application file for complete search history.

(56) References Cited

U.S. PATENT DOCUMENTS 4,460,174 A * 7/1984 Perry ..... F41B 15/00 463/47.4
11,280,578 B1 * 3/2022 Moran ..... F41B 15/00
2014/0060454 A1 * 3/2014 Lash ..... A01K 27/009 119/770

* cited by examiner

*Primary Examiner* — Peter J Iannuzzi
(74) *Attorney, Agent, or Firm* — Jack E. Ebel

(57) ABSTRACT

A self-defense device having a handle, a spool and a line. One end of the line is secured to the handle while the other end of the line is secured to the spool. As assembled, the line is coiled around the spool and the spool is inserted through an opening of the handle. One end of the spool is sized to abut the handle while the other end of the spool is sized and configured extend within the opening and be releasably secured therein. To deploy the device, a user grasps the handle and releases the spool from engagement therewith thereby allowing gravity to unwind the line from the spool.

20 Claims, 3 Drawing Sheets

134
137
131
137

50
130
20
40

50
20
130
40

234
238
237
231
230
238
237

50
230
20
40

20
230
50
40

334
338
330
338
337
331
337

50
330
20
40

20
50
330
40

SELF-DEFENSE DEVICE

BACKGROUND OF THE INVENTION

The present invention relates to a self-defense device that as assembled from component parts can be discretely worn on a belt, carried in a pocket or stored and transported in a myriad of other manners, and more particularly, to such a device that can be quickly disassembled and deployed.

For centuries people have carried and used instruments to defend themselves. One such instrument was the Manriki Gusari, a weighted chain that originated in Japan. Although the weighted chain was a practical weapon when introduced, it became an impractical defense instrument in the modern world as the chain becomes easily tangled when carried in a concealed manner, for example in a pocket or bag, and therefore wasn't able to be deployed quickly. Further, the weighted chain wasn't capable of being deployed discretely when carried in an open manner.

Accordingly, a need exists for a self-defense device or assembly that incorporates a weighted chain into a practical carry, self-defense device that is easily and quickly deployed for civilian, civil servant, and military protection.

BRIEF SUMMARY OF THE INVENTION

To achieve the foregoing and other objects, and in accordance with the purposes of the present invention, as embodied and broadly described herein, one embodiment of the present invention is a self-defense assembly comprising a handle having an opening therethrough. A line attached at or near one end thereof to the handle and attached at or near the other end to a spool. The spool is configured to be inserted within the opening in the handle and releasably secured to the handle.

Another embodiment of the present invention is a process comprising self-defense device comprising a handle having an opening therethrough and a spool having a first end inserted within the opening and a second end which abuts the handle. A line is wrapped around the spool and has one end secured to the handle and the other end secured to the spool.

Yet another embodiment of the present invention comprises A self-defense device comprises a ring having an opening therethrough, a generally cylindrical spool inserted within the opening. The spool has a first end with external dimensions that are larger than the opening, a second end with external dimensions less than the first end and an intermediate portion with external dimensions less than the first end and the second end. A line is wrapped around the intermediate portion of the spool and has a first end secured to the first end of the spool and a second end secured to the ring. The spool is inserted within the opening until the first end abuts the ring. A member is releasably secured to the second end of the spool so as to allow the ring, the spool and the line to be transported together.

DETAILED DESCRIPTION OF THE INVENTION

Figure 1A:
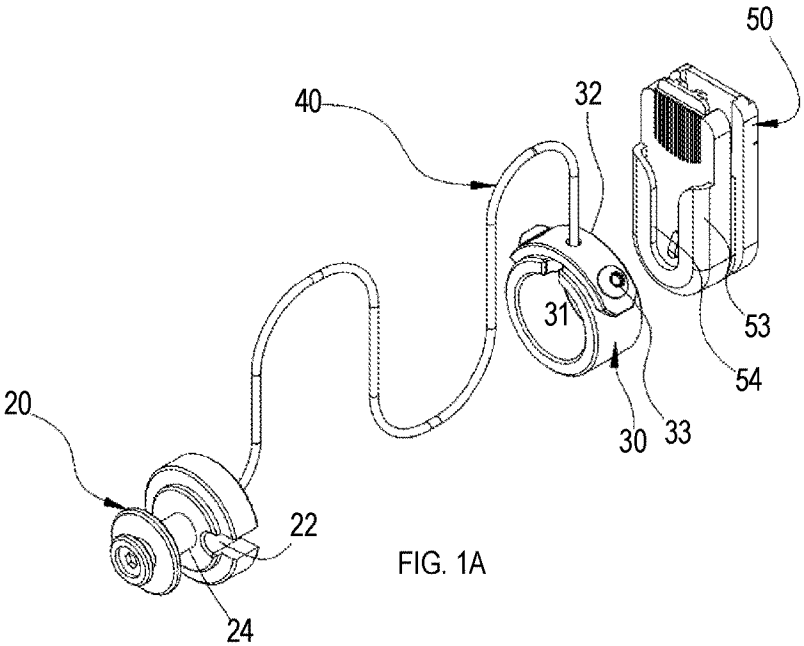
FIG. 1A is perspective view of the device of the present invention disassembled for use in self-defense.
Figure 1C:
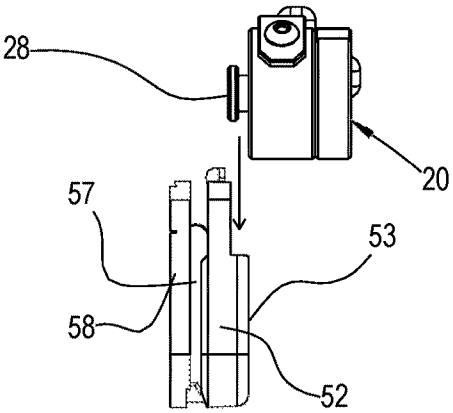
FIG. 1C is a perspective view of the device of the present invention partially assembled.
Figure 1:
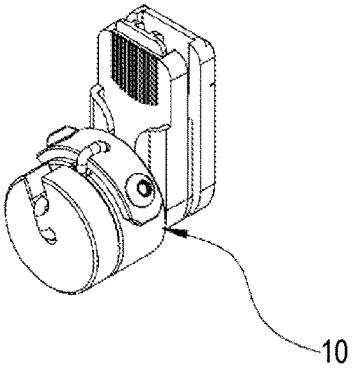
FIG. 1 is a perspective view of the device of the present invention as fully assembled.

The device or assembly of the present invention is illustrated generally as 10 in FIG. 1 and comprises a handle 30, an spool 20, a line 40 which connects the handle to the spool at or near opposite ends thereof and an optional carrying member 50 (FIG. 1A). Handle 30 has an opening 31 which is sized and configured to accommodate at least one digit of a user inserted through the opening as deployed. Spool 20 may be elongated in form.

Spool 20 has a first end 21, a second end 28 having external dimensions less than first end 21 and an intermediate partition 26 having external dimensions greater than second end 28 but less than first end 21. First generally cylindrical body portion 24 extends between first end 21 and intermediate partition 26 while a second generally cylindrical body portion 27 extends between intermediate partition 26 and second end 28. First end 21 preferably includes a notch 22 in the outer periphery thereof for receiving line 40 as the component parts are assembled. Line 40 has one end thereof secured to handle 30 by any suitable means as will be evident to a skilled artisan, such as a clamp 32 which is secured to handle 30 by screws or welds 33. The other end of line 40 is secured to first end 21 of spool 20 by any suitable means, such as a knot, swage or adhesive. Although the spool 20 and handle 30 are illustrated as generally circular in cross section (with handle 30 being essentially a ring), each may have other suitable cross sectional configurations adapted to mate, such as square, rectangular or oval, as will be evident to a skilled artisan. The external cross sectional configuration of handle 30 can also be varied.

Spool 20 and handle 30 can be made from any variety of materials, including steel, brass, stainless steel, copper, rubbers, plastics or any combination thereof while line 40 can be any number of high strength ropes or lines commercially available, such as Kevlar® brand wire, high molecular weight polyethylene (HMWPE) wire, wire, such as that commercially available from Spectra Wire & Cable Group, wire rope or equivalents. Spool 20 and handle 30 may be integrally formed or assembled from component parts that are secured together by any suitable means as will be evident to a skilled artisan.

Carrier 50 has a body portion 52 having a first outer face 53 extending partially along the length thereof and defining a gap 55 with the body portion 52 that is sized and configured to receive second end 28 of spool 20 as assembled. A slot 54 is formed in outer face 53 that is sized and configured to receive body portion 27 of spool 20 as assembled. A second outer face 56 of the body portion 52 has a clip or clamp 58 pivotally secured thereto, preferably defining a gap 57 therebetween. As illustrated, clip 58 allows the device of the present invention to be worn on a user's clothing, such as belt, pants, strap, inside a pocket or wherever is convenient, or on a pack, bag, briefcase or other article being conveyed by a user.

As disassembled (FIG. 1A), the device of the present invention is ready for the user grabbing handle 30 or holding handle 30 by having at least one digit (finger or thumb) inserted into opening 31 in handle 30 to deploy the device to strike and/or grapple in self-defense or use the device for self-defense in any other manner as will be evident to a skilled artisan.

Figure 1B:
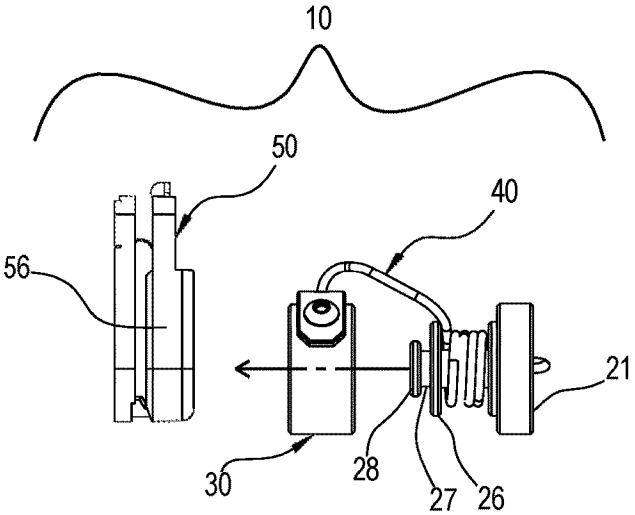
FIG. 1B is a perspective view of the device of the present invention with component parts aligned for assembly.

After use, the device 10 can be assembled for storage by first inserting line 40 through notch 22 in the first end 21 of spool 20 and then wrapping line 40 around the first body portion 24 spool 20 as generally illustrated in FIG. 1B, thus preventing tangling of the line 40 during storage. The second end 28 of spool 20 is configured to pass through opening 31 in handle 30 while the first end 21 of spool 20 is configured to abut the handle and therefore preventing spool 20 from completely passing through the handle. As the spool and handle are mated or assembled, the second end 28 of the spool extending from the handle is sized and configured to be received within gap 57 of carrier 50 while second body portion 27 of spool 20 is received within slot 54 of carrier 50 as illustrated in FIGS. 1 and 1C. Carrier 50 preferably includes a quick release clip. The clip should be quick release via button, lever, pin, spring or other means (not illustrated) as will be evident to a skilled artisan and capable of being worn in several configurations (or alone). The device of the present invention can be sized to accommodate users of different heights, weights and abilities. Alternatively, carrier 50 may not include a clip or similar mechanism to attached same to clothing and can be of any configuration so long as it includes a slot, gap or similar construction to receive the second end 28 of spool 20 as mated with handle 30. In this embodiment, device 10 may be stored and transported in a pocket, purse, bag, briefcase, suitcase or any other means of carrying it as will be evident to a skilled artisan.

To deploy the device of the present invention, the spool 20 and handle 30 are manually detached from carrier 50 (FIG. 1C), the user allows spool 20 to disengage with handle 30 (FIG. 1B) and the line 40 is unwound from spool 20 (FIGS. 1A and 1B) manually or by gravity.

Alternative embodiments of the handle 30 of the device of the present invention are illustrated in FIGS. 2, 2A, 2B, 3, 3A, 3B, 4, 4A and 4B. Each of these embodiments provide increased stability of the handle as secured in the user's hand during deployment and use and also provide additional self-defense capabilities.

Figures 2, 2A, 2B, 3, 3A, 3B, 4, 4A, 4B:
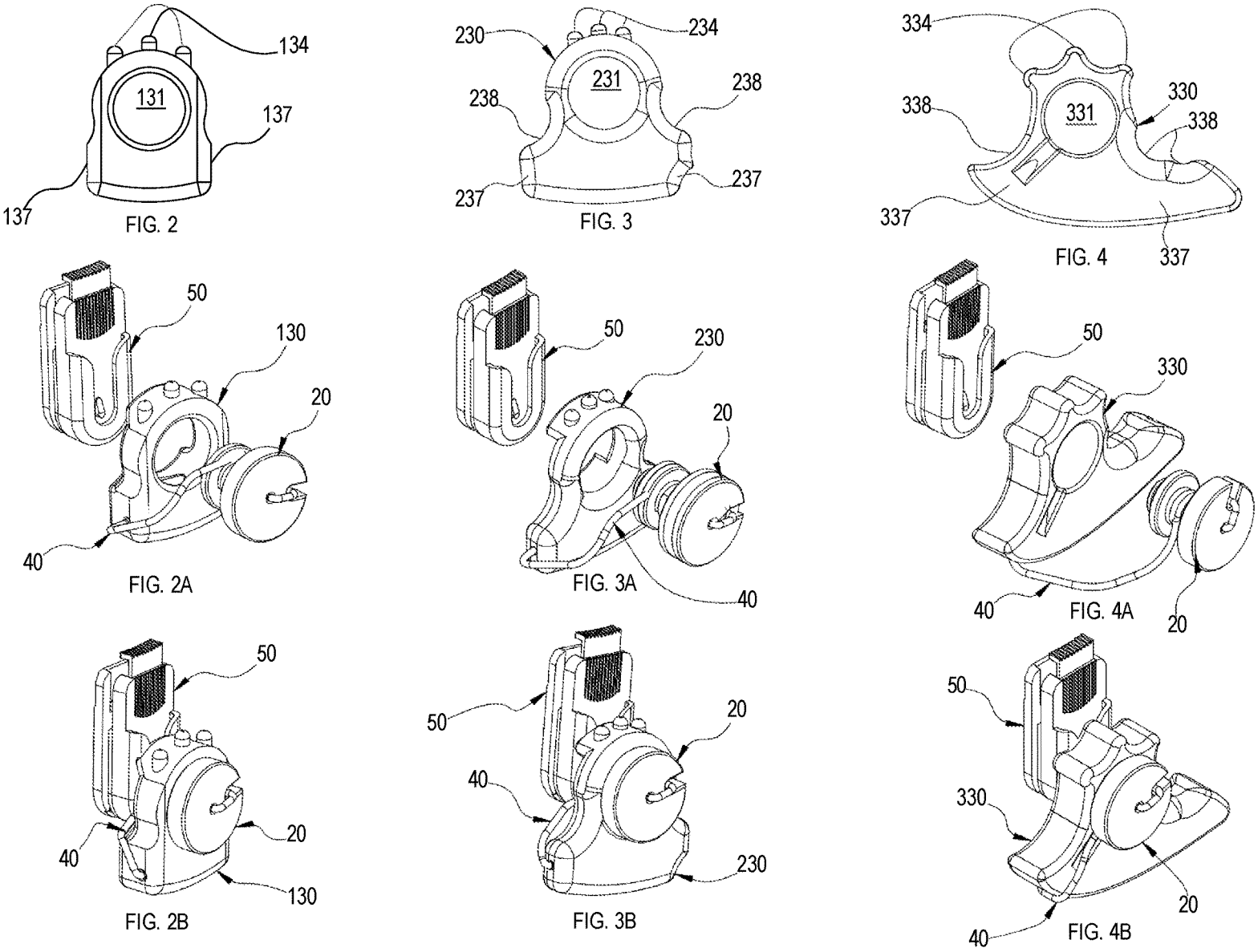
FIG. 2 is a front view of an another embodiment of a handle used in the device of the present invention.
FIG. 2A is a perspective view of the device of the present invention with component parts including the handle of FIG. 2 as aligned for assembly.
FIG. 2B is a perspective view of the device of the present invention as fully assembled with the handle embodiment of FIG. 2.
FIG. 3 is a front view of a further embodiment of a handle used in the device of the present invention.
FIG. 3A is a perspective view of the device of the present invention with component parts including the handle of FIG. 3 as aligned for assembly.
FIG. 3B is a perspective view of the device of the present invention as fully assembled with the handle embodiment of FIG. 3.
FIG. 4 is a front view of a still further embodiment of a handle used in the device of the present invention.
FIG. 4A is perspective view of the device of the present invention with component parts including the handle of FIG. 4 as aligned for assembly.
FIG. 4B is a perspective view of the device of the present invention as fully assembled with the handle embodiment of FIG. 4.

As illustrated in FIGS. 2, 2A and 2B, a handle 130 has an opening 131 there through and one or more protuberances 134 formed on or attached to the outer surface of the handle as gripped in the hand of a user. Such protuberances 134 serve as a rough surface in the event a user has to strike a threat with his hand while gripping handle 130. Handle 130 has an enlarged body portion 137 that provides a grip for a user's hand during deployment while one or more digit may be inserted through opening 131. The enlarged portion provides for a better grip and increased stability of the handle during use and inhibits rotation of the handle in the user's hand. In this embodiment, the line 40 is secured to the handle 130 by any suitable means, such as by a knot, swage or adhesive, as will be evident to a skilled artisan.

As illustrated in FIGS. 3, 3A and 3B, a handle 230 has an opening 231 there through and one or more protuberances 234 formed on or attached to the outer surface of the handle as gripped in the hand of a user. Such protuberances 134 serve as a rough surface in the event a user has to strike a threat with his hand while gripping handle 230. Similar to the embodiment illustrated in FIG. 2, an enlarged body portion 237 provides a grip for a user's hand during deployment while one or more digits may be inserted through opening 231. However, the enlarged body portion 237 in this embodiment provides tapered ridges 238 to support user's digits adjacent opening 231 during use thereby providing increased stability and inhibiting rotation of the handle 230.

As illustrated in FIGS. 4, 4A and 4B, a handle 330 has an opening 331 there through and one or more ridges 334 along the outer surface of the handle as gripped in the hand of a user. Such ridges 334 serve as a rough surface in the event a user has to strike a threat with his hand while gripping handle 330. Somewhat similar to the embodiments illustrated in FIGS. 2 and 3, an enlarged body portion 337 provides a grip for a user's hand while one or more digit may be inserted through opening 331. However the enlarged body portion 337 in this embodiment provides tapered ridges 338 to support two of user's digits on one side of the opening 331 and one digit on the other side of opening 331 while a digit is inserted through the opening 331 thereby providing increased stability and inhibiting rotation of the handle 330.

Figure 5:
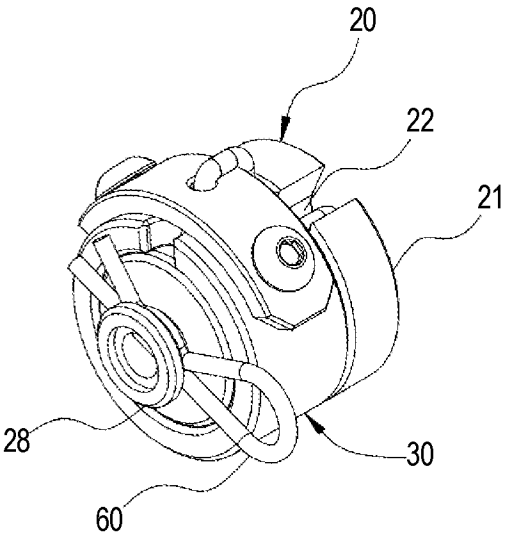
FIG. 5 is a perspective view of another embodiment of the device of the present invention.

As illustrated in FIG. 5, the handle 30, spool 20 and line 40 as illustrated in FIGS. 1 and 1A are mated together as illustrated in FIGS. 1B and 1C and are releasably secured in this mated position by means of a cotter pin 60 positioned through a hole or bore (not illustrated) formed in second generally cylindrical body portion 27 of spool 20. When the self-defense device of this embodiment is deployed for use, the user pulls the cotter pin 60 from engagement with the bore through the second generally cylindrical body portion 27, and while grasping handle 30 allows the spool 20 to disengage from the handle 30 and line 40 to unfurl. In this embodiment, second end 28 may or may not be included in the design of spool 20. Other means of securing spool 20 within handle 30 as mated will be evident to a skilled artisan, for example other locking pins, a clamp on the outside of second generally cylindrical body portion 27, or a quick release mechanism built into spool 20, handle 30 or both. As an example of a quick release mechanism suitable for use with this embodiment of the present invention, the second generally cylindrical body portion 27 may be provided with a ball detent locking mechanism in which one or more retractable balls extend beyond the outer periphery of second body portion 27 once spool is mated with handle 30 thereby engaging an edge of handle 30 and securing the handle and spool together. A mechanism is provided to retract the balls to permit disengagement of spool 20 and handle 30 during deployment as will be evident to a skilled artisan. The spool 20 and handle 30 can each be provided with one of the cooperating male and female components of a quick release locking mechanism to keep them mated during storage and transportation. In this embodiment, the need for a separate carrier is eliminated and device 10 may be stored and transported in a pocket, purse, bag, briefcase, suitcase or any other means of carrying it as will be evident to a skilled artisan. Alternatively, a clip may be secured to an outer surface of handle 30 or spool 10 in a manner as will be evident to a skilled artisan to allow the device 10 to be secured to a user's clothing, such as belt, pants, strap, inside a pocket or wherever is convenient, or on a pack, bag, briefcase or other article being conveyed by a user.

This alternative means of releasably securing the spool and handle of the present invention together (discussed above with one embodiment illustrated in FIG. 5) is equally applicable for use with the handle embodiments disclosed herein and illustrated in FIGS. 2-4.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by some amount. Whenever a numerical range with a lower limit and an upper limit is disclosed, any number and any included range falling within the range are specifically disclosed.

What is claimed is:

1. A self-defense assembly comprising:

a handle having an opening therethrough;

a spool partially inserted within the opening in the handle and releasably secured to the handle; and a line attached at or near one end thereof to the handle and attached at or near the other end thereof to the spool, the line being coiled around the spool as assembled.

2. The assembly of claim 1 wherein said spool has one end thereof sized to abut the handle while the other end of the spool is sized to be inserted within the opening.

3. The assembly of claim 1 further comprising:

a clip secured to the handle.

4. The assembly of claim 1 further comprising:

a clip secured to the spool.

5. The assembly of claim 1 further comprising:

a member having a slot, the other end of the spool passing through the handle being releasably secured within the slot and thereby releasably secured to the handle.

6. The assembly of claim 5 wherein the member includes a clip secured thereto.

7. The assembly of claim 2 further comprising:

a clip releasably secured to the other end of the spool.

8. The assembly of claim 7 wherein the clip is a cotter pin.

9. The assembly of claim 1 wherein the handle is a ring.

10. The assembly of claim 1 wherein the handle has an enlarged portion for a user to grip while deploying the assembly.

11. A self-defense device comprising:

a handle having an opening therethrough;

a spool having a first end inserted within the opening and a second end which abuts the handle thereby preventing the spool from completely passing through the opening; and a line wrapped around the spool and having one end secured to the handle and the other end secured to the spool.

12. The device of claim 11 further comprising:

a member releasably attached to the first end of the spool to secure the spool and the handle together.

13. The device of claim 12 wherein the member has a slot into which the first end of the spool is releasably mated with.

14. The device of claim 13 where the member has clip to allow it to be secured to a user.

15. The device of claim 12 wherein the member is a cotter pin and the first end of the spool is provided with a hole through which the cotter pin is inserted.

16. A self-defense device comprising:

a ring having an opening therethrough;

a spool inserted within the opening, the spool having a first end with external dimensions that are larger than the opening, a second end with external dimensions less than the first end and an intermediate portion with external dimensions less than the first end and the second end, the spool being inserted within the opening until the first end abuts the ring;

a line wrapped around the intermediate portion of the spool and having a first end secured to the first end of the spool and a second end secured to the ring; and a member releasably secured to the second end of the spool so as to allow the ring, the spool and the line to be transported together.

17. The device of claim 16 wherein the member has a slot formed in one face thereof.

18. The device of claim 17 wherein the second end of the spool is mated within the slot.

19. The device of claim 18 wherein the member has a clip on another face for being secured to a user for transportation.

20. The device of claim 16 wherein the spool is cylindrical.

* * * * *